United States Patent [19]

Streit et al.

[11] Patent Number: 4,507,220

[45] Date of Patent: Mar. 26, 1985

[54] AQUEOUS SUSPENSIONS OF PEROXYDISULFATES AND THEIR USE AS OXIDATIVE DESIZING AGENTS FOR TEXTILE GOODS SIZED WITH STARCH

[75] Inventors: Werner Streit, Bobenheim; Linda Witt, Mannheim; Heinz-Dieter Angstmann, Ludwigshafen, all of Fed. Rep. of Germany

[73] Assignee: BASF Aktiengesellschaft, Ludwigshafen, Fed. Rep. of Germany

[21] Appl. No.: 452,491

[22] Filed: Dec. 23, 1982

[30] Foreign Application Priority Data

Jan. 28, 1982 [DE] Fed. Rep. of Germany ..... 3202760

[51] Int. Cl.[3] ..... D06L 1/14

[52] U.S. Cl. ..... 252/186.1; 8/138

[58] Field of Search ..... 252/186.1; 8/138

[56] References Cited

U.S. PATENT DOCUMENTS 4,309,298 1/1982 Adrian et al. ..... 252/95

4,344,764 8/1982 Kothe et al. ..... 8/138

FOREIGN PATENT DOCUMENTS 281743 5/1970 Austria .

*Primary Examiner*—John Kight

*Assistant Examiner*—Marvin L. Moore

*Attorney, Agent, or Firm*—Oblon, Fisher, Spivak, McClelland & Maier

[57] ABSTRACT

Water-containing peroxydisulfate suspensions containing potassium peroxydisulfate, a water-soluble polymer or copolymer of acrylic acid and/or maleic acid, with or without an anionic surfactant, where appropriate mixed with a non-ionic surfactant, and water, in which the aqueous phase contains from 12 to 65% by weight of not less than one other dissolved compound which keeps the system at a pH of not less than 5 and is a source of potassium ions.

9 Claims, No Drawings

AQUEOUS SUSPENSIONS OF PEROXYDISULFATES AND THEIR USE AS OXIDATIVE DESIZING AGENTS FOR TEXTILE GOODS SIZED WITH STARCH

BACKGROUND OF THE INVENTION

Description of the Prior Art

Peroxydisulfates have long been known as oxidants for desizing textile goods sized with starch. Austrian Patent No. 281,743 discloses desizing processes which are carried out at a pH of about 10 and use an alkali metal or ammonium peroxydisulfate solution. German Laid-Open Application DOS No. 2,913,177 discloses an oxidative desizing agent consisting of from 10 to 80% by weight of a surfactant and from 20 to 90% by weight of potassium peroxydisulfate. Finally, German Published Application DAS No. 2,814,354 discloses an oxidative desizing process in which peroxydisulfate is used as the desizing agent, together with a water-soluble polymer of acrylic acid.

All these processes have the common feature that the agents must be stored and metered in solid form, since peroxydisulfates lose their activity fairly rapidly in aqueous solution, as a result of decomposition, even if the solution is made weakly alkaline, as would be the case, for example, with the agents disclosed in German Published Application DAS No. 2,814,354.

However, because of the difficult metering technique, solid products, such as peroxydisulfate, or semi-solid (pasty) products as disclosed in German Laid-Open Application DOS No. 2,913,177 are not particularly welcomed by the customer.

It is an object of the present invention to convert the peroxydisulfate into a storage-stable, extremely fluid and easily meterable form which, like the solid formulations hitherto proposed, ensures satisfactory or even better oxidative desizing.

We have found that this object is achieved by water-containing suspensions of potassium peroxydisulfate as defined in claims 1 and 2.

We have found, surprisingly, that, in spite of the presence of water, the peroxydisulfate does not decompose in this suspension if the water contains additional potassium ions. These potassium ions evidently have an effect on the solubility product of potassium peroxydisulfate such that the peroxydisulfate becomes virtually insoluble under the conditions of storage in water and is thus in finely disperse form and is not attacked by the water. The peroxydisulfate dissolves, and can become active in the intended sense, only under the desizing conditions, where it is in highly dilute form.

The suspensions according to the invention necessarily contain potassium peroxydisulfate, a polymer or copolymer of acrylic acid and/or maleic acid and the water containing additional potassium ions. The amount of potassium peroxydisulfate in the suspension is preferably from 15 to 40% by weight, in particular from 20 to 30% by weight, based on the suspension.

For the purposes of the invention, polymers or copolymers of acrylic acid or maleic acid are those which are water-soluble, and in particular polyacrylic acid and polymaleic acid themselves, and the copolymers are preferably those which contain, as comonomer units, not more than 50% by weight of monoethylenically unsaturated compounds which can be copolymerized with acrylic acid or maleic anhydride, eg. methacrylic acid and $C_1$–$C_4$-alkyl acrylates or methacrylates, and copolymers of maleic acid with methyl vinyl ether, vinyl acetate, styrene, acrylic acid or methacrylic acid. Other copolymers are described in the above German Published Application DAS No. 2,814,354, which is hereby incorporated by reference. However, polyacrylic acid and polymaleic acid are of particular industrial interest.

All the polymers should have a Fikentscher K value of from 8 to 30, preferably from 10 to 20, and they are preferably used in amounts of from 2 to 35% by weight, in particular from 9 to 30% by weight.

Preferably, from 5 to 35% by weight of water containing the additional $K^{\oplus}$ ions is required. These ions preferably originate from compounds which supply potassium ions and are capable of assisting in bringing the pH to the required value of not less than 5, ie., in particular, KOH, potassium carbonate or $K_2O$. Other compounds, such as $K_2SO_4$, potassium phosphate or KCl, may also be used. The aqueous phase contains from 12 to 65% by weight of the potassium compounds, which substantially corresponds to not less than the saturation concentration, ie. the exact percentages depend, within the above limits, on the particular potassium compound used.

This system is a storable liquid suspension which can easily be metered and can successfully be used in desizing liquors.

Suspensions which are still easier to meter, and can even be pumped, are obtained by adding, preferably, not more than 75% by weight, in particular from 25 to 45% by weight, based on the newly formed suspension, of an anionic surfactant conforming to the above definition, in particular a $C_8$–$C_{20}$-alkanol half-ester of phosphoric or sulfuric acid, or an oxyethylate thereof containing from 1 to 7 ethylene oxide units. $C_{10}$–$C_{20}$-alkane-sulfonates and alkylbenzenesulfonates and sulfated alkyl-phenolethoxylates are also suitable anionic surfactants. Finally, non-ionic surfactants, in particular $C_8$–$C_{20}$-alkanol-oxyethylates containing from 1 to 10 ethylene oxide groups, may also be present, although not exclusively, preferably in an amount of not more than 40% by weight.

The suspensions made up in this manner are very useful as oxidative desizing agents for textile goods sized with starch, and the desizing liquors generally contain from 4 to 20 g/liter, preferably from 6 to 13 g/liter of these suspensions. Depending on the surfactant content of the persulfate suspension, the liquor also contains wetting agents and detergents, but these additional agents may be dispensed with if the surfactant content of the suspension is relatively high.

The Examples which follow illustrate the invention.

EXAMPLES

The mixtures were stored at 50° or 80° to test their stability. The particular persulfate content was determined titrimetrically by dissolving 1 g of the mixture in 50 ml of a 40/10 solution of $H_2O$ and isopropanol and adding 50 ml of KI solution having a concentration of 300 g/liter. After fifteen minutes at room temperature, the mixture was titrated with 0.1N sodium thiosulfate solution until it turned colorless.

EXAMPLE 1

35 parts of $C_{10}H_{21}$—O—$(CH_2$—$CH_2O)_3PO_3H_2$
35 parts of $C_{10}H_{21}$—O—$(CH_2$—$CH_2O)_3H$
15 parts of 66% strength polyacrylic acid, of K value 15–25, in $H_2O$
15 parts of $K_2S_2O_8$
7 parts of KOH (pH of final solution, 6.1)=32% by weight in the aqueous phase
Water content: 6.9%

The $K_2S_2O_8$ content was monitored at a storage temperature of 50° C.

| | 1 day | 7 days | 14 days | 21 days |
|---|---|---|---|---|
| $K_2S_2O_8$ content in percent of the starting value | 100% | 98.3% | 96% | 91% |

When used in an amount of 10 g/liter of the sizing liquor for desizing loomstate plain-weave cotton fabric, with a residence time of the fabric of 15 minutes at 100°, a sample which had been stored at 50° for three weeks produced the same desizing effect as the starting sample. A Tegewa value of 8 was achieved in both cases.

COMPARATIVE EXAMPLE FOR EXAMPLE 1

35 parts of $C_{10}H_{21}$—O—$(CH_2CH_2O)_3$—$PO_3H_2$
35 parts of $C_{10}H_{21}$—O—$(CH_2$—$CH_2O)_3$—H
15 parts of 66% strength polyacrylic acid, of K value 15–25, in $H_2O$
15 parts of $K_2S_2O_8$
5 parts of NaOH (pH of final solution, 6.1)
Storage at 50° C.:

| | 1 day | 7 days | 14 days |
|---|---|---|---|
| $K_2S_2O_8$ content in percent of the starting value | 91% | 41% | 4.5% |

When used in an amount of 10 g/liter of desizing liquor and under conditions which were otherwise identical to those in Example 1, the comparative sample produced an adequate desizing effect only immediately after its preparation (Tegewa value of 8). After storage for seven days, a Tegewa value of only 4 was achieved by desizing.

EXAMPLE 2

70 parts of $C_{13}H_{27}$—$O(CH_2CH_2))_5PO_3H_2$
3 parts of 75% strength polyacrylic acid, of K value 10–26, in $H_2O$
15 parts of $K_2S_2O_8$
6 parts of 60% strength KOH solution
2.5 parts of KOH (pH of final solution, 6.2) equal to 53% in the aqueous phase
Water content: 5.3%
Storage at 50°:

| | 1 day | 7 days | 14 days | 21 days |
|---|---|---|---|---|
| $K_2S_2O_8$ content in percent of the starting value | 98.1% | 95% | 91% | 90.2% |

The mixture was used for oxidative desizing.
General recipe:
50 g/liter of NaOH
3–5 g/liter of surfactant of the nonylphenolpolyethylene glycol ether type When the mixture was added to desizing liquor in an amount of 12.5 g/liter, an adequate desizing effect (Tegewa value of 8) was achieved, even after the mixture has been stored at 50° for three weeks, on loomstate plain-weave cotton fabric with a liquor pick-up of 100% and a residence time of 5 minutes at from 100° to 105° C.

COMPARATIVE EXAMPLE 2

70 parts of $C_{13}H_{27}$—O—$(CH_2$—$CH_2$—$O)_5PO_3H$
3 parts of 75% strength polyacrylic acid, of K value 10–20, in $H_2O$
15 parts of $K_2S_2O_8$
6.5 parts of 65% strength NaOH (pH of final solution, 6.2)
Storage at 50°:

| | 1 day | 7 days | 14 days | 21 days |
|---|---|---|---|---|
| $K_2S_2O_8$ content in percent of the starting value | 89% | 48.5% | 7.1% | 1.2% |

Using the comparative samples in the desizing liquor in the amounts and under the conditions given in Example 2, desizing was no longer possible after the samples had been stored at 50° for 14 days.

EXAMPLE 3

54 parts of 50% strength polyacrylic acid, of K value 9–14, in $H_2O$
16 parts of KOH (pH 7.9), equal to 23% in the aqueous phase
30 parts of $K_2S_2O_8$
Water content: 32%
Storage at 80° C.:

| | 10 hours | 16 hours | 40 hours |
|---|---|---|---|
| $K_2S_2O_8$ content in percent of the starting value | 96% | 90% | 69% |

Storage at 50° C.:

| | 1 day | 7 days | 14 days | 21 days |
|---|---|---|---|---|
| $K_2S_2O_8$ content in percent of the starting value | 98.1% | 95.8% | 94.3% | 91.2% |

COMPARATIVE EXAMPLE 3

54 parts of 50% strength polyacrylic acid, of K value 9–14, in $H_2O$
12 parts of NaOH (pH 8.0)
30 parts of $K_2S_2O_8$
Storage at 80° C.:

| | 10 hours | 16 hours | 40 hours |
|---|---|---|---|
| $K_2S_2O_8$ content in percent of the starting value | 79% | 65% | 3.0% |

Storage at 50° C.:

| | 1 day | 7 days | 14 days | 21 days |
|---|---|---|---|---|
| $K_2S_2O_8$ content in percent of the starting value | 96% | 87% | 78% | 62% |

EXAMPLE 4

45 parts of 50% strength polyacrylic acid, of K value

12–16, in $H_2O$
14 parts of KOH (pH 8.3)
5 parts of $K_2SO_4$, equal to 27.5% in the aqueous phase
5 parts of $H_2O$
30 parts of $K_2S_2O_8$
Water content: 32%
Storage at 50°:

| | 1 day | 7 days | 14 days | 21 days |
|---|---|---|---|---|
| $K_2S_2O_8$ content in percent of the starting value | 97.8% | 96% | 94.1% | 91.7% |

The stability of the mixture is reduced even by replacing the 5 parts of $K_2SO_4$ by 5 parts of $Na_2SO_4$.

COMPARATIVE EXAMPLE 4

45 parts of 50% strength polyacrylic acid, of K value 12–16, in $H_2O$
14 parts of KOH (pH 8.3)
5 parts of $Na_2SO_4$
5 parts of $H_{20}$
30 parts of $K_2S_2O_8$
Storage at 50°:

| | 1 day | 7 days | 14 days | 21 days |
|---|---|---|---|---|
| $K_2S_2O_8$ content in percent of the starting value | 95.1% | 90% | 81% | 72% |

When added to desizing liquor in an amount of 6 g/liter, the mixtures from Examples 3 and 4 gave Tegewa values of from 8 to 9 on loomstate cotton plain-weave and twill fabrics at a liquor pick-up of 100%, a liquor temperature of from 100° to 130° C. and a residence time of 10 minutes.

We claim:

1. A water-containing peroxydisulfate suspension containing
10–40% by weight of potassium peroxydisulfate,
2–45% by weight of a water-soluble polymer or copolymer of acrylic acid and/or maleic acid,
which may in addition contain 0–80% by weight of an anionic surfactant, selected from the group consisting of $C_8$–$C_{20}$-alkanol half-ester of phosphoric or sulfuric acid, and an oxyethylation product thereof containing from 1 to 7 ethylene oxide units, which may be mixed with a non-ionic surfactant, and
5–55% by weight of water,
wherein the aqueous phase contains from 12 to 65% by weight of not less than one other dissolved compound which keeps the system at a pH of between about 5 and 10 and is a source of potassium ions.

2. The peroxydisulfate suspension of claim 1 containing from 20–30% by weight of potassium peroxydisulfate;
9–30% by weight of the polymer;
25–45% by weight of the anionic surfactant; and
up to 35% by weight of water.

3. The peroxydisulfate suspension of claim 1 wherein the polymer is a copolymer of polyacrylic acid and polymaleic acid.

4. The peroxydisulfate suspension of claim 3 wherein the comonomer used for the copolymer is up to 50% by weight of a monoethylinically unsaturated compounds.

5. The peroxydisulfate suspension of claim 4 wherein the comonomer is copolymerized with a monomer selected from the group consisting of methacrylic acid, ($C_1$–$C_4$) alkyl acrylates or methacrylates, and copolymers of maleic acid with methyl vinyl ether, vinyl acetate, styrene, acrylic acid or methacrylic acid.

6. The peroxydisulfate suspension of claim 1 wherein the anionic surfactant is selected from the group consisting of ($C_8$–$C_{20}$) alkanol half ester of phosphoric or sulfuric acid, or an oxyethylate thereof containing from 1 to 7 ethylene oxide units, ($C_{10}$–$C_{20}$) alkansulfonates and alkylbenzenesulfonates and sulfated alkylphenolethoxylates.

7. The peroxydisulfate suspension of claim 1 wherein the non-ionic surfactants are selected from the group consisting of ($C_8$–$C_{20}$) alkanol-oxyethylates containing from 1 to 10 ethylene oxide groups.

8. The peroxydisulfate suspension of claim 1 containing an anionic surfactant which may be mixed with a non-ionic surfactant.

9. A method for stabilizing peroxydisulfate for use in desizing of textiles, comprising:
forming the peroxydisulfate suspension of claim 1.

* * * * *